US005499821A

United States Patent [19]

Rycroft

[11] Patent Number: 5,499,821

[45] Date of Patent: Mar. 19, 1996

[54] BASKETBALL GAME AMUSEMENT DEVICE

[76] Inventor: Vance Rycroft, Box 51, Site 2, R.R. #1, Grande Prairie, Alberta, Canada, T8V 2 8

[21] Appl. No.: 498,293

[22] Filed: Jul. 3, 1995

[51] Int. Cl.[6] ..... A63F 7/00

[52] U.S. Cl. ..... 273/357; 273/394; 273/399

[58] Field of Search ..... 273/357, 394, 273/395, 396, 397, 399

[56] References Cited

U.S. PATENT DOCUMENTS

| | | | |
|---|---|---|---|
| 3,834,701 | 9/1974 | Hashimoto | 273/357 X |
| 4,177,992 | 12/1979 | Todokoro | 273/399 X |
| 4,245,842 | 1/1981 | Kuna et al. | 273/357 |

FOREIGN PATENT DOCUMENTS 1404264 8/1975 United Kingdom .

*Primary Examiner*—William H. Grieb
*Attorney, Agent, or Firm*—Anthony R. Lambert

[57] ABSTRACT

A basketball game amusement device includes a base and a partition to divide the base into a first court and a second court. A first basket is positioned on a first side of the partition facing the first court. A second basket is positioned on a second side of the partition facing the second court. Competitive interest is maintained by positioning a conduit immediately below each basket. When a projectile passes through the basket it is directed by the conduit onto the opponents court. The number of projectiles on the court provides an objective indication to the player as to whether he is winning or losing. A winner is declared when one of the players disposes of all of his projectiles onto the opponent's court.

1 Claim, 3 Drawing Sheets

BASKETBALL GAME AMUSEMENT DEVICE

FIELD OF THE INVENTION

The present invention relates to a basketball game amusement device.

BACKGROUND OF THE INVENTION

Amusement devices that use as their underlying theme the fundamentals of the game of basketball are well known. Efforts have been made to add a competitive dimension to such games by pitting two players against each other in such a fashion that a winner and a loser can be can objectively determined. An Example of such a competitive game is U.K. Patent specification 1,404,264 by Hashimoto that was published Aug. 28, 1975. In the Hashimoto reference two replicas of basketball courts are positioned back to back. A scoreboard is positioned at the top of a dividing partition between the two courts. An actuating arm is positioned below each basket. As a ball passes through the basket it strikes the actuating arm resulting in the scoreboard being advanced, such that the relative scores of the players are always displayed during the course of the match. A timing mechanism is provided which governs the duration of the match. The player with the highest score the timed interval is the winner.

The Hashimoto reference, while accomplishing its object of establishing a competitive interest, is relatively expensive to manufacture. Over prolonged use the timing mechanism, the actuating arm and the scoreboard all will fail in the absence of servicing.

SUMMARY OF THE INVENTION

What is required is basketball game amusement device which is less expense to manufacture and yet has features that will maintain competitive interest.

According to the present invention there is provided a basketball game amusement device including a base and a partition extending substantially vertically from the base to divide the base into a first court and a second court. The partition has a first side facing the first court and a second side facing the second court. A first basket is secured to the first side of the partition. A second basket is secured to the second side of the partition. A first projectile launcher is positioned on the first court, whereby basketball-like projectiles are launched toward the first basket. A second projectile launcher is positioned on the second court, whereby basketball-like projectiles are launched toward the second basket. A first conduit is provided having a basket end and a partition end. The basket end is positioned immediately below the first basket, such that a projectile passing through the first basket is directed into the first conduit. The partition end passes through the partition from the first court to the second court. The basket end is elevated in relation to the partition end, such that a projectile entering the basket end of the first conduit travels by force of gravity to the partition end where it exits the first conduit onto the second court. A second conduit is provided having a basket end and a partition end. The basket end is positioned immediately below the second basket, such that a projectile passing through the second basket is directed into the second conduit. The partition end passes through the partition from the second court to the first court. The basket end is elevated in relation to the partition end, such that a projectile entering the basket end of the second conduit travels by force of gravity to the partition end where it exits the second conduit onto the first court.

With the basketball game amusement device, as described above, competitive interest is maintained by the positioning of the conduits connecting the basket of one player with the court of the opposing player. A player is given immediate objective evidence as to whether he is winning or losing making recourse to a scoreboard unnecessary.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 2:
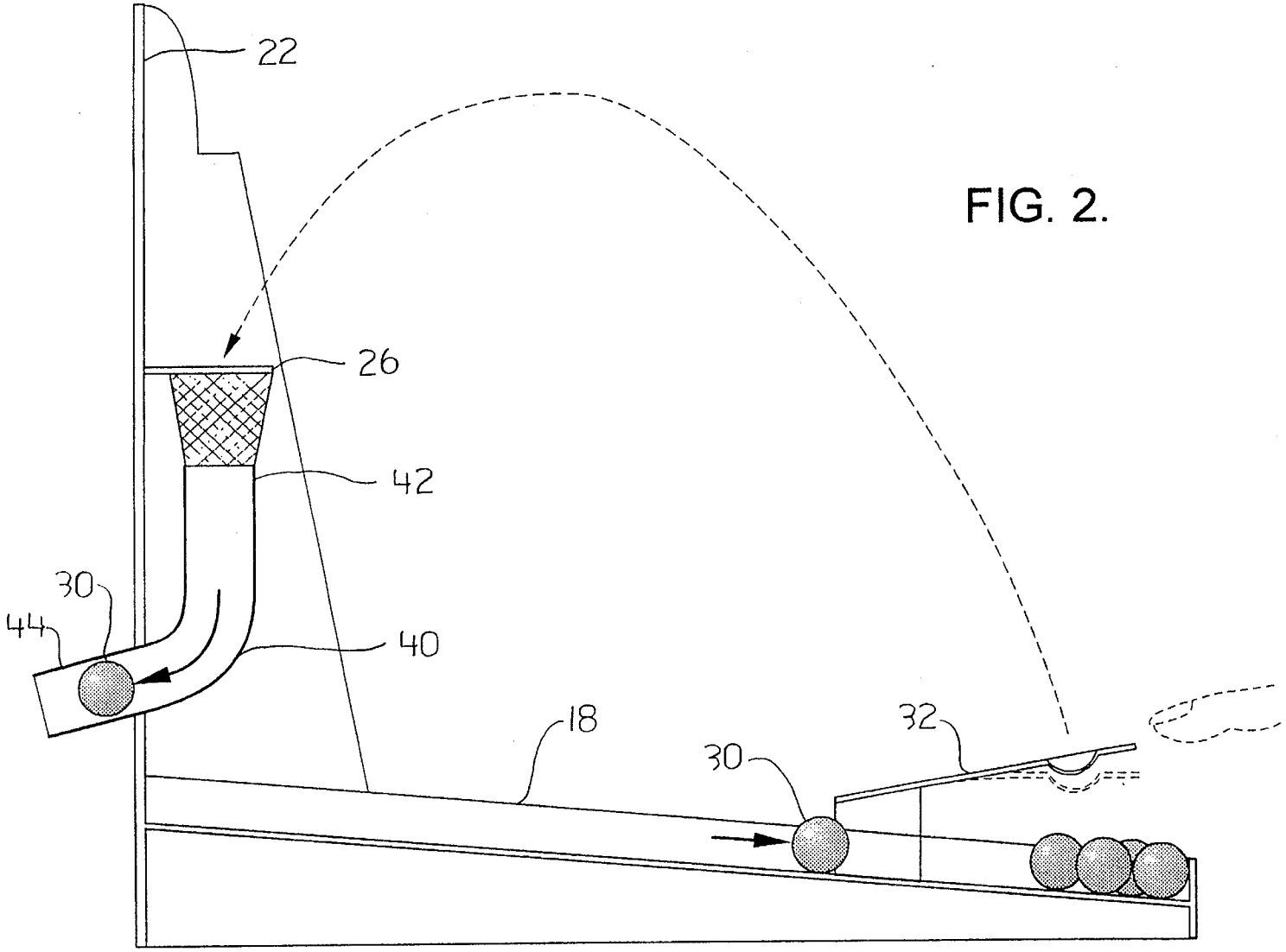
FIG. 2 is a detailed side elevation view of the basketball game amusement device illustrated in FIG. 1.
Figure 3:
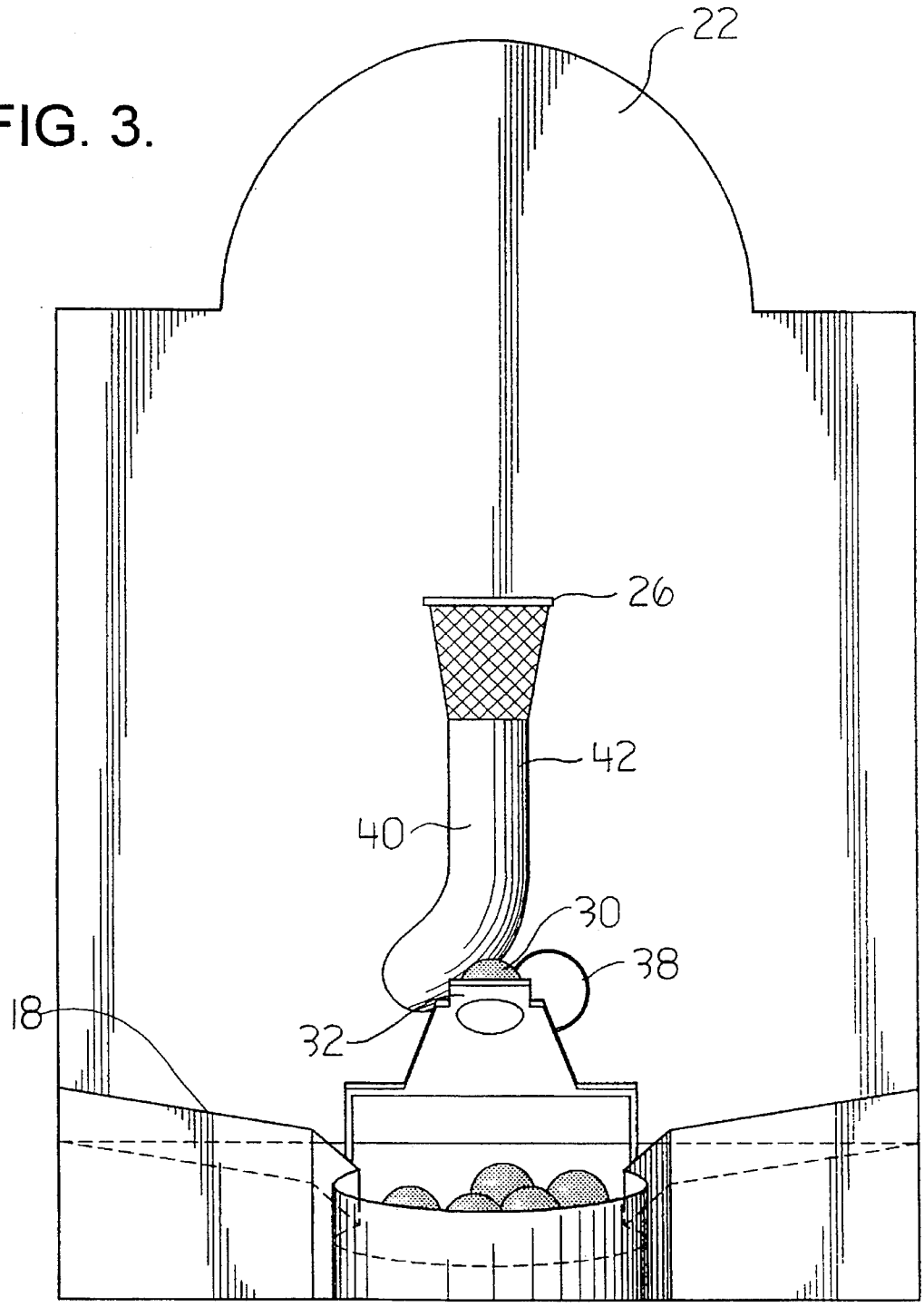
FIG. 3 is an end view of the basketball amusement device illustrated in FIG. 1.

The preferred embodiment, a basketball game amusement device generally identified by reference numeral 10, will now be described with reference to FIGS. 1 through 3.

Figure 1:
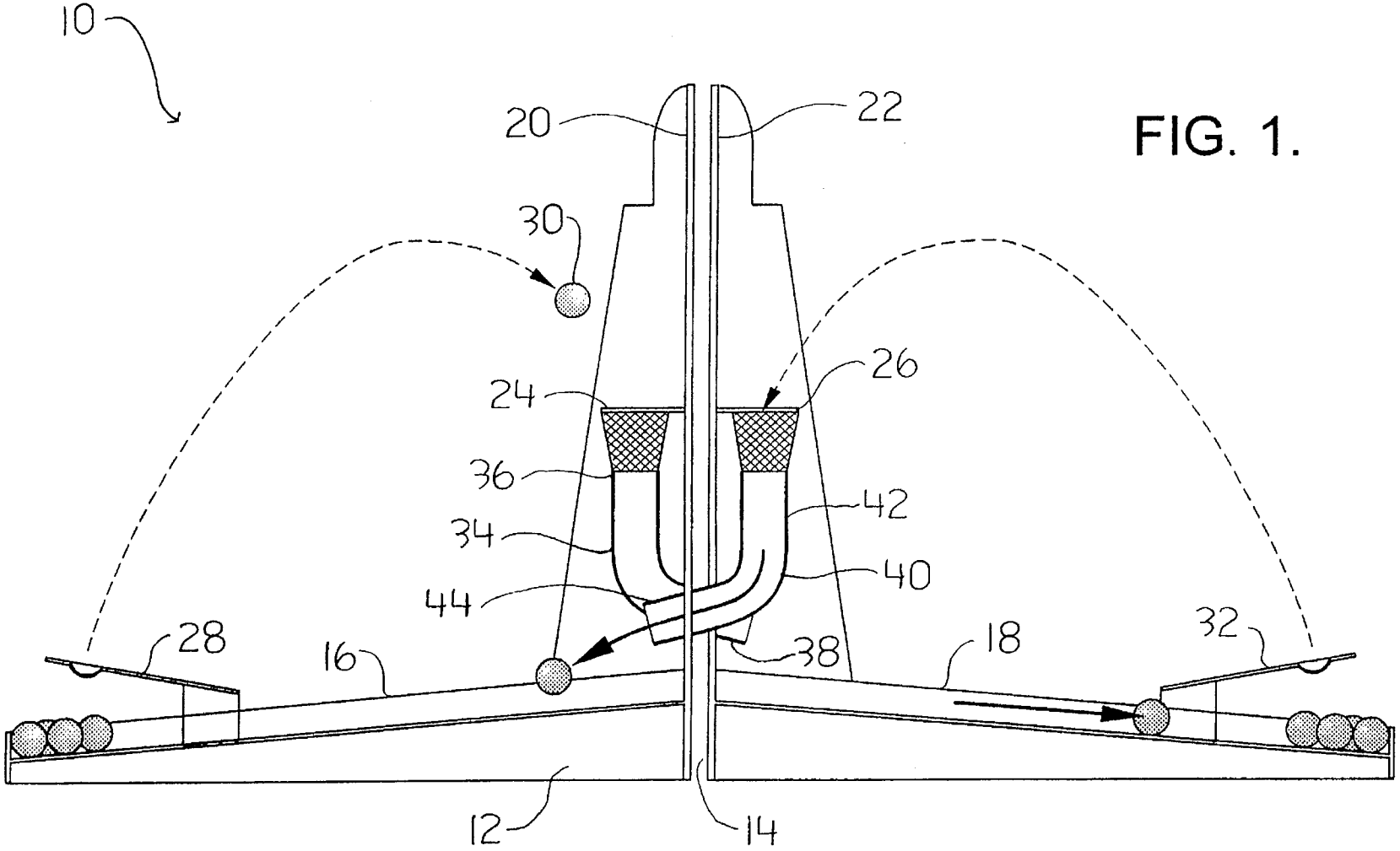
FIG. 1 is a side elevation view in section of a basketball game amusement device constructed in accordance with the teachings of the present invention.

Referring to FIG. 1, basketball game amusement device 10 includes a base 12 and a partition 14. Partition 14 extends substantially vertically from base 12 and serves to divide base 12 into a first court 16 and a second court 18. Partition 14 has a first side 20 facing first court 16 and a second side 22 facing second court 18. A first basket 24 is secured to first side 20 of partition 14. A second basket 26 is secured to second side 22 of partition 14. A first projectile launcher 28 is secured to first court 16 of base 12. First projectile launcher 28 serves to launch basketball-like projectiles 30 toward first basket 24. A second projectile launcher 32 is secured to second court 18 of base 12. Second projectile launcher 32 serves to launch basketball-like projectiles 30 toward second basket 26. A first conduit 34 is provided having a basket end 36 and a partition end 38. Basket end 36 is positioned immediately below first basket 24, such that projectile 30 passing through first basket 24 is directed into first conduit 34. Partition end 38 passes through partition 14 from first court 16 to second court 18. Basket end 36 is elevated in relation to partition end 38, such that projectile 30 entering basket end 36 of first conduit 34 travels by force of gravity to partition end 38 where it exits first conduit 34 onto second court 18. A second conduit 40 is provided having a basket end 42 and a partition end 44. Basket end 42 is positioned immediately below second basket 26, such that projectile 30 passing through second basket 26 is directed into second conduit 40. Partition end 44 passes through partition 14 from second court 18 to first court 16. Basket end 42 is elevated in relation to partition end 44, such that projectile 30 entering basket end 42 of second conduit 40 travels by force of gravity to partition end 44 where it exits second conduit 40 onto first court 16.

The use and operation of basketball game amusement device 10 will now be described with reference to FIGS. 1 through 3. This game is intended for two players, hereinafter referred to as a first player and a second player, playing in competition with one another. The first player and the second player are each given an equal number of projectiles

30. The first player uses first projectile launcher 28. The second player uses second projectile launcher 32. The competitive interest is created by the routing of projectiles 30 through first conduit 34 and second conduit 40. When the first player successful launches one of projectiles 30 into first basket 24, projectile 30 passes through first basket 24 and is directed by first conduit 34 onto second court 18. This adds an additional projectile 30 to the number of projectiles 30 that the second player is playing with on second court 18. Similarly, when the second player successfully launches one of projectiles 30 into second basket 26, projectile 30 passes through second basket 26 and is directed by second conduit 40 onto first court 16. It can be seen that as the game progresses the first player and the second player will be directing projectiles 30 by means of first conduit 34 and second conduit 40, respectively, onto their opponents courts. Eventually, either the first player or the second player will emerge victorious by disposing of all of his or her projectiles 30 on the court of the opposing player.

It will be apparent to one skilled in the art how competitive interest will be maintained by a basketball game amusement device, as described above, in which the opposing players exchange projectiles by means of conduit connecting the basket of one player with the court of the opposing player. It will also be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A basketball game amusement device, comprising:

a base;

a partition extending substantially vertically from the base to divide the base into a first court and a second court, the partition having a first side facing the first court and a second side facing the second court;

a first basket secured to the first side of the partition;

a second basket secured to the second side of the partition;

a first projectile launcher positioned on the first court, whereby basketball-like projectiles are launched toward the first basket;

a second projectile launcher positioned on the second court, whereby basketball-like projectiles are launched toward the second basket;

a first conduit having a basket end and a partition end, the basket end being positioned immediately below the first basket such that a projectile passing through the first basket is directed into the first conduit, the partition end passing through the partition from the first court to the second court, the basket end being elevated in relation to the partition end, such that a projectile entering the basket end of the first conduit travels by force of gravity to the partition end where it exits the first conduit onto the second court; and a second conduit having a basket end and a partition end, the basket end being positioned immediately below the second basket such that a projectile passing through the second basket is directed into the second conduit, the partition end passing through the partition from the second court to the first court, the basket end being elevated in relation to the partition end, such that a projectile entering the basket end of the second conduit travels by force of gravity to the partition end where it exits the second conduit onto the first court.

* * * * *